US005172028A

United States Patent [19]

Watanabe

[11] Patent Number: 5,172,028

[45] Date of Patent: Dec. 15, 1992

[54] FLUORESCENT DISPLAY DEVICE

[75] Inventor: Hiroshi Watanabe, Mobara, Japan

[73] Assignee: Futaba Denshi Kogyo K.K., Mobara, Japan

[21] Appl. No.: 583,842

[22] Filed: Sep. 13, 1990

[30] Foreign Application Priority Data

Sep. 14, 1989 [JP] Japan ..... 1-107265[U]

[51] Int. Cl.[5] ..... H01J 63/04

[52] U.S. Cl. ..... 313/495; 313/496; 313/497

[58] Field of Search ..... 313/495, 496, 497; 315/169.1; 340/783, 752

[56] References Cited

U.S. PATENT DOCUMENTS 4,164,683 8/1979 Nakamura et al. ..... 313/496
4,217,578 8/1980 Inami et al. ..... 313/497
4,626,741 12/1986 Morimoto et al. ..... 313/497
4,899,081 2/1990 Kishino et al. ..... 313/496

FOREIGN PATENT DOCUMENTS 50-111986 9/1975 Japan .
63-231482 9/1988 Japan .

*Primary Examiner*—Donald J. Yusko
*Assistant Examiner*—Diab Hamadi
*Attorney, Agent, or Firm*—Oblon, Spivak, McClelland, Maier & Neustadt

[57] ABSTRACT

A fluorescent display device including a graphic display section and a segment display section capable of being highly simplified in construction and readily manufactured at a low cost. The fluorescent display device includes control electrode structures for both display sections each of which is constituted by a plurality of linear control electrodes divided into predetermined groups.

4 Claims, 4 Drawing Sheets

FLUORESCENT DISPLAY DEVICE

BACKGROUND OF THE INVENTION

This invention relates to a fluorescent display device, and more particularly to a fluorescent display device including a graphic display section and a segment display section.

Conventionally, a fluorescent display device is known in which a segment display section including luminous segments arranged in a predetermined pattern and a graphic display section adapted to carry out a desired character or figure display by means of a plurality of luminous dots are constructed integral with each other. In the so-constructed fluorescent display device, the segment display section and graphic display section are merely arranged in a single envelope, wherein a drive system and an electrode structure for the segment display section are constructed in a manner different from those for the graphic display section.

More particularly, the segment display section, as disclosed in, for example, Japanese Patent Application Laid-Open Publication No. 111986/1975, is conventionally constructed according to a so-called intermediate mounting system wherein mesh grids are fixed on an anode substrate within an envelope. The so-constructed segment display section is driven according to a dynamic drive system wherein the mesh grids are scanned in turn to supply a display signal synchronized with the scanning to segment anodes.

On the contrary, the graphic display section arranged in the same envelope, as disclosed in, for example, Japanese Patent Application Laid-Open Publication No. 231482/1988, is generally constructed in such a manner that a plurality of linear grids are arranged in parallel with one another above an anode substrate and both ends of the grids are interposedly held and adhesively fixed with respect to the sealing portion of the envelope. The so-constructed graphic display section is driven according to a dual wire grid drive system wherein each adjacent two linear grids are scanned one by one in turn and anodes each are supplied with a display signal synchronized with the scanning.

In the conventional fluorescent display device, as described above, the segment display section and graphic display section are constructed different in electrode structure and drive system from each other. This renders the manufacturing of the fluorescent display device highly complicated and troublesome, to thereby cause the respective display sections to require drive circuits separate from each other.

Also, in the conventional fluorescent display device, the two display sections employing different electrode structures and drive systems are arranged in the same envelope, resulting in a wiring pattern provided on the anode substrate being complicated and the width of the pattern being decreased. This renders the use of an ITO film exhibiting large resistance impossible and, as a result, the conventional fluorescent display device is compelled to substitute an Al wiring of small resistance therefor. Therefore, particularly in a front emission type fluorescent display device (FLVFD), it is required to form an anti-reflection film on an anode substrate to prevent light reflected on the Al wiring from adversely affecting a display site and then form the Al wire on the anti-reflection film, resulting in manufacturing of the display device being further complicated.

SUMMARY OF THE INVENTION

The present invention has been made in view of the foregoing disadvantages of the prior art.

Accordingly, it is an object of the present invention to provide a fluorescent display device including both a graphic display section and a segment display section which is capable of highly simplifying the structure and being readily manufactured.

In accordance with the present invention, there is provided a fluorescent display device which includes a graphic display section and a segment display section. The fluorescent display device includes a control electrode means for each of the graphic display section and segment display section. The control electrode means comprises a plurality of linear control electrodes divided into predetermined groups.

In the fluorescent display device of the present invention constructed as described above, the control electrode means for each of the graphic display section and segment display section comprises linear control electrodes divided into predetermined groups. Thus, both display sections can be driven by means of a drive system common thereto.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a fluorescent display device according to the present invention will be described hereinafter with reference to the accompanying drawings.

FIGS. 1 to 7 show an embodiment of a fluorescent display device according to the present invention. A fluorescent display device of the illustrated embodiment is the type that luminescence or light-emission of phosphors deposited on an anode substrate is observed from a control electrode side and is constructed into a tetrode structure including two kinds of linear control electrode means. Now, a general structure of the fluorescent display device will be described with reference to FIGS. 3 and 4.

Figure 4:
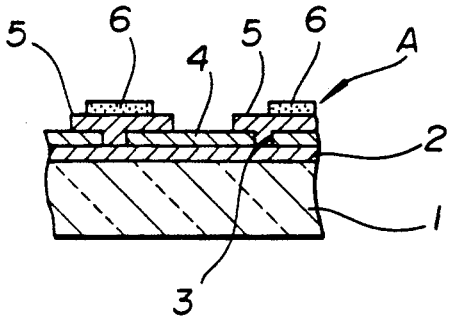
FIG. 4 is a fragmentary sectional view detailedly showing an electrode structure of the embodiment of FIG. 1 including an anode means.

The fluorescent display device of the illustrated embodiment, as shown in FIG. 4, includes an anode substrate 1 constituting a part of an envelope, wiring conductors 2 provided on the inner surface of the anode substrate 1, and a cross layer 4 formed with through-holes 3. On the cross layer 4 are deposited anode conductors 5 in a predetermined pattern, which are made of graphite and connected via the through-holes 3 to the wiring conductor 2. Also, the fluorescent display device includes phosphors 6 deposited on the anode conductors 5 in a predetermined pattern, resulting in an anode means A which serves as a luminous display section of the fluorescent display section.

Figure 3:
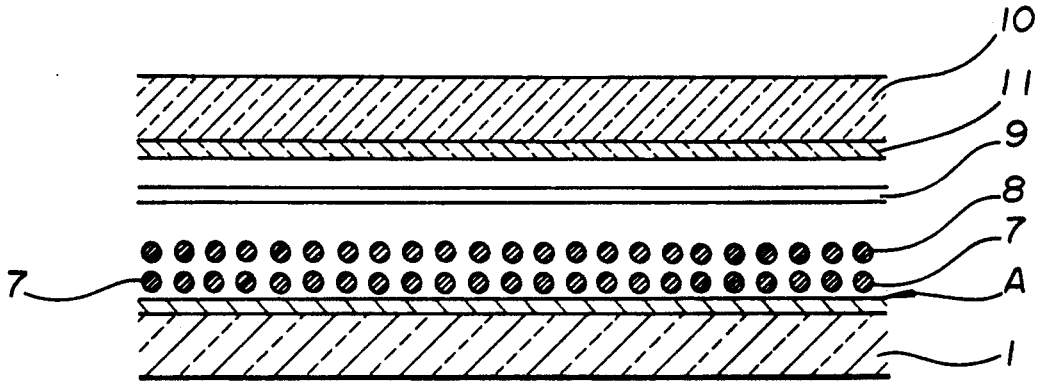
FIG. 3 is a fragmentary sectional view showing an essential part of the embodiment of FIG. 1.

Above the anode means A, as shown in FIG. 3, a second control electrode means 7 which comprises a plurality of linear control electrodes is arranged perpendicularly across the longitudinal direction of the anode substrate 1 on which the anode means A is arranged. Both ends of the control electrodes constituting the second control electrode means 7 are connected together and interposedly fixed to the sealing portion of the envelope. The second control electrode means 7 serves to focus electron beams before they are impinged on the anode means A, to thereby permit the fluorescent display device to carry out a display with high definition and high luminance, therefore, the second control electrode means is not necessarily required for the fluorescent display device.

Above the second control electrode means 7, as shown in FIG. 3, a first control electrode means 8 which comprises a plurality of linear control electrodes is arranged. The linear control electrodes constituting the first control electrode means 8 are made of a fine metal wire and arranged at the same intervals as the linear control electrodes constituting the second control electrode means 7. The first control electrodes 8 and second control electrodes 7 are arranged in parallel to each other and in a manner to be vertically aligned with each other. The control electrodes for the first control electrode means 8 are likewise interposedly fixed at both ends thereof to the sealing portion of the envelope.

The fluorescent display device of the illustrated embodiment also includes filamentary cathodes 9 arranged above the first control electrodes 8 so as to extend in a direction perpendicular to the first control electrodes 8. On the inner surface of a transparent front cover 10 constituting a part of the envelope is deposited a Nesa film 11 which is a transparent conductive film.

Now, an essential part of the illustrated embodiment will be described hereinafter with reference to FIGS. 1 and 2.

Figure 1:
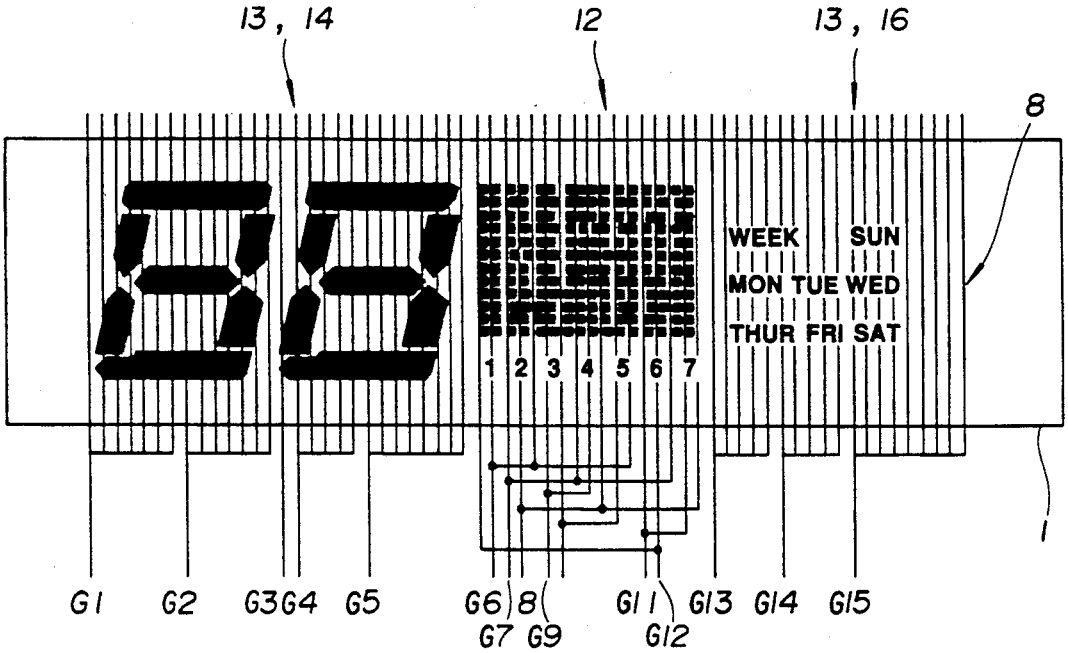
FIGURE 1 is a diagrammatic view showing the manner of connection of a first control electrode means in an embodiment of a fluorescent display device according to the present invention.
Figure 2:
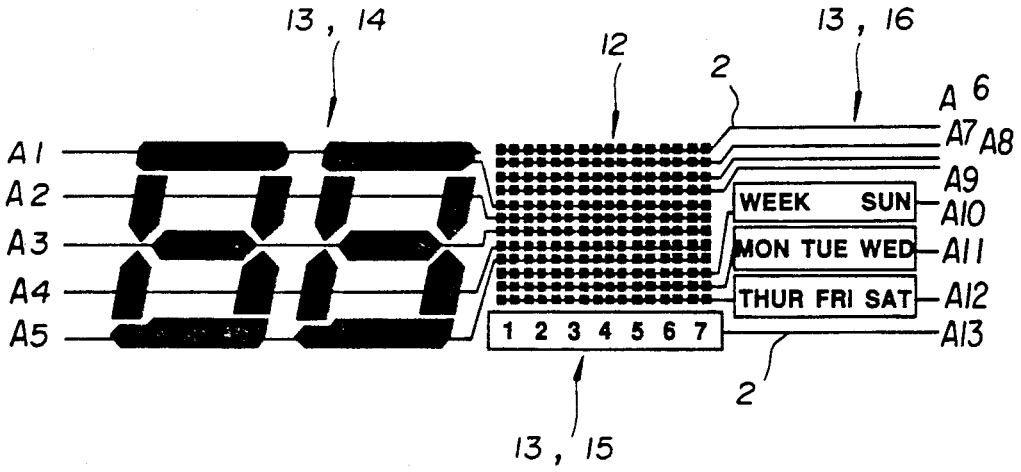
FIG. 2 is a diagrammatic view showing the manner of connection of an anode means in the embodiment of FIG. 1.

As shown in FIGS. 1 and 2, the above-described anode means A constitutes a graphic display section 12 and a segment display section 13. The graphic display section 12 comprises 192 dot-like anodes arranged in a matrix of 12 rows $\times$ 16 columns at predetermined intervals. The segment display section 13 comprises two numeral display sections 14 and 15 and a day display section 16. One numeral display section 14 is adapted to display a number of two digits and, for this purpose, each digit comprises seven segments arranged in the shape of the number 8. The other numeral display section 15 is arranged below the graphic display section 12. The day display section 16 is adapted to display a day of the week.

The linear control electrodes constituting the first control electrode means 8, as shown in FIG. 1, each are arranged so as to extend in a direction perpendicular to the longitudinal direction of the anode substrate 1 and in a manner to be parallel with each other at predetermined intervals. The linear control electrodes of the first control electrode means 8 which face the numeral display section 14 for displaying a number of two digits, as shown in FIG. 1, are divided into two groups for every digit, resulting in control electrode groups G1 and G2 and control electrode groups G4 and G5. Between the two numeral display portions of the numeral display section 14 between which a gap of a luminous pattern is formed is left a control electrode group G3 comprising one linear control electrode so as to serve as a buffer for both numeral display portions. The control electrodes of the first control electrode means 8 for the day display section 16, as shown in FIG. 1, are divided into three control electrode groups G13, G14 and G15. Also, the control electrodes of the first control electrode means 8 positioned above the graphic display section 12 and the other numeral display section 15 are divided into a plurality of groups each comprising two or three control electrodes, and the control electrodes of the respective groups are connected together to form control electrode groups G6, G7, G8, G9, G10, G11 and G12.

The segments of each of the display sections are connected in such a manner as shown in FIG. 2 by means of the wiring conductors 2, resulting in being externally led out in the form of thirteen routes of anodes A1 to A13 arranged in the longitudinal direction of the anode substrate 1. The number of anodes A1 to A13 led out is determined so as to correspond to that (the number of rows) required for the graphic display section 12. In the illustrated embodiment, thirteen anodes are lead out, because not only the graphic display section 12 but the numeral display section 15 arranged below the graphic display section 12 are included. Thus, in the illustrated embodiment, the maximum number of anodes for a luminous pattern which carries out light-emission within a region of the first control electrode means surrounded by the linear control electrodes are led out.

Figure 6:
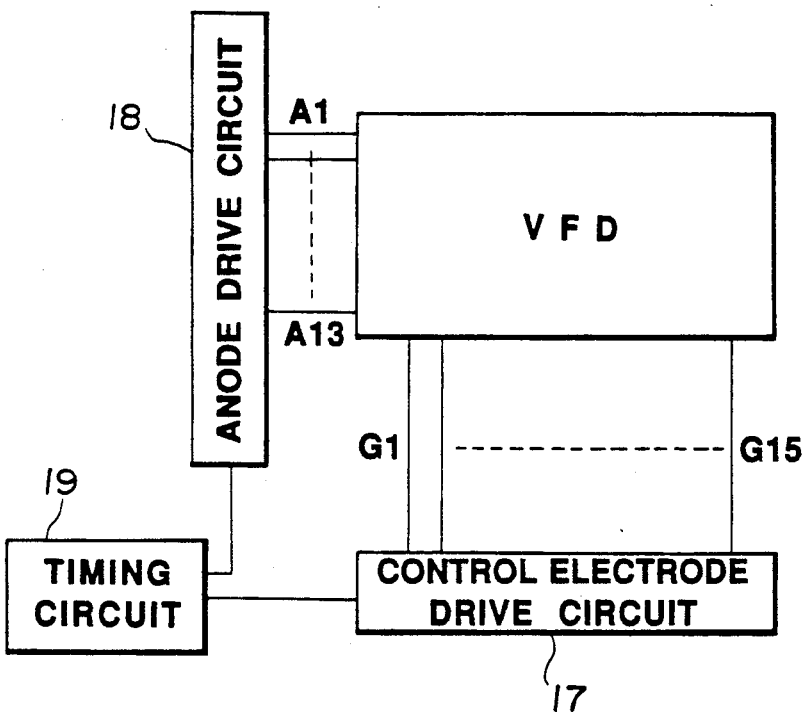
FIG. 6 is a block diagram showing the embodiment of FIG. 1.

The control electrode groups G1 to G15, as shown in FIG. 6, are connected to a control electrode drive circuit 17 and the anodes A1 to A13 are connected to an anode drive circuit 18. The control electrode drive circuit 17 and anode drive circuit 18 are connected to a common timing circuit 19, resulting in being driven in synchronism with each other.

Now, the manner of operation of the fluorescent display device of the illustrated embodiment constructed as described above will be described hereinafter.

A DC voltage is constantly applied to the filamentary cathodes 9. Also, a positive potential of a level between a voltage of the first control electrode means 8 and that of the anode means A is constantly applied to the second control electrode means 7.

Figure 7:
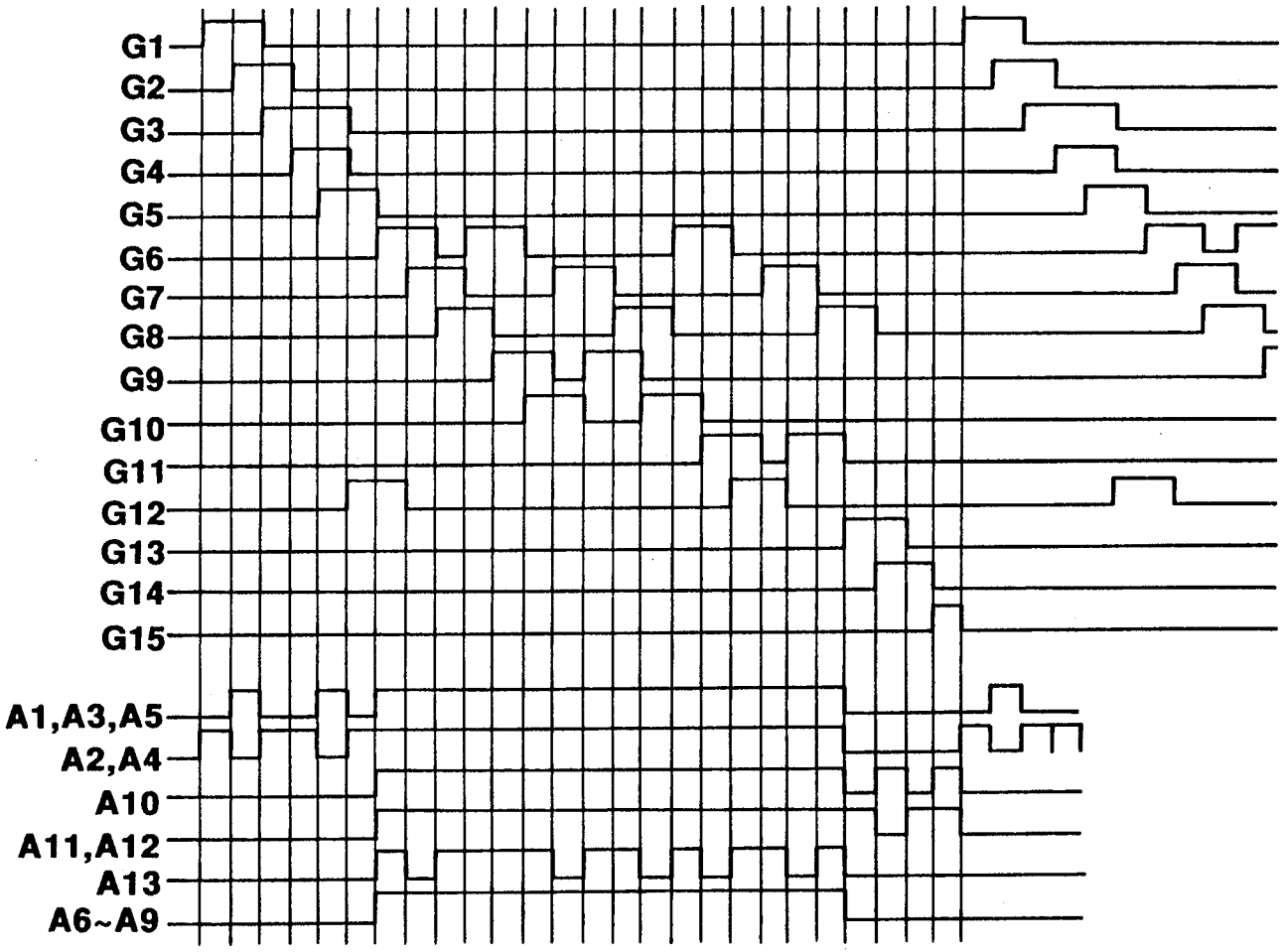
FIG. 7 is a wave form chart showing a waveform of a drive signal for permitting light-emission of all display sections in the embodiment shown in FIG. 1.

Then, the control electrode groups G each are scanned by means of the common control electrode drive circuit 17 and, in synchronism with the scanning, a display signal is supplied to the anode means A. In this instance, as shown in FIG. 7, the scanning of the control electrode groups G1 to G5 and G13 to G15 facing the segment display section 13 is carried out while overlapping time of half of a pulse between each adjacent control electrode groups except the control electrode group forming the gap of the luminous pattern. The scanning of the control electrode groups G6 to G12 facing the graphic display section 12 is carried out in a manner to successively move on the respective adjacent two linear control electrodes toward a high level while shifting the two control electrodes one by one. In this instance, a signal of a high level is applied to unnecessary control electrodes as well; therefore, a predetermined negative voltage is applied to the control electrodes unselected, to thereby surround the control electrodes with a negative electric field to eliminate the affection of the control electrodes, resulting in preventing leakage luminance.

Then, when a display signal is supplied to the anode means A at a timing as shown in FIG. 7 in synchronism with the scanning of the control electrode groups G, all the display sections 12 and 13 of the illustrated embodiment are permitted to carry out luminescence or light emission.

Also, when the width of a pulse for scanning of the control electrode groups G is varied, time during which each of the display sections emits light is adjusted, to thereby provide a difference in luminance between the display sections.

The illustrated embodiment is increased in the number of control electrodes for the numeral display section 14 including seven segments and decreased in duty ratio, as compared with the conventional fluorescent display device of the dynamic drive system. However, this is readily compensated by increasing the drive voltage correspondingly. In this regard, it will be readily understood that the fluorescent display device of the illustrated embodiment includes the graphic display section, resulting in necessarily requiring to increase the drive voltage.

The control electrodes for the illustrated embodiment each may be formed by etching. Alternatively, they may be made of a metal wire material. This permits manufacturing of the control electrodes at a low cost.

Figure 5:
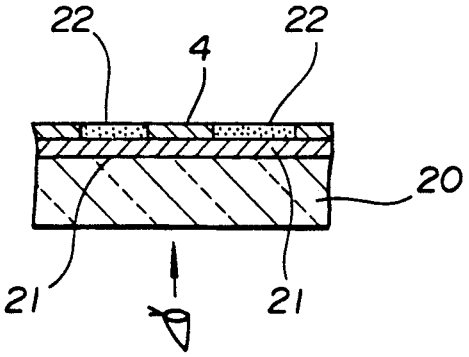
FIG. 5 is a fragmentary sectional view showing an anode structure of a FLVFD to which the present invention can be applied.

The illustrated embodiment has been described in connection with the fluorescent display device of the type that a luminous display is observed through the front cover. However, the present invention may be effectively applied to a front emission type fluorescent display device (FLVFD) constructed as shown in FIG. 5 wherein light emitted from phosphors 22 is observed through an anode substrate 20 and an anode conductor 21 which are transparent. This permits a wiring pattern on the anode substrate to be simplified to increase the width of the wiring pattern, so that the wiring may be formed of an ITO film exhibiting relatively large resistance, resulting in eliminating the necessity of providing an anti reflection film.

In the illustrated embodiment, the control electrodes for each of the control electrode groups G6 to G12 are connected together, however, the control electrodes may be driven two by two in order while being shifted.

As can be seen from the foregoing, the present invention is so constructed that in the composite-type fluorescent display device including the graphic display section and segment display section, the control electrode means for both display sections comprise a plurality of linear control electrodes divided into predetermined groups. Such construction of the present invention permits the control electrode structure for the composite-type fluorescent display device to be rendered common for every display section, to thereby unify a drive system. This results in the manufacturing of the fluorescent display device being simplified enough to significantly reduce the manufacturing cost. Also, this simplifies a wiring pattern on the anode substrate, so that particularly in the FLVFD, the wiring may be formed of an ITO film, resulting in eliminating the provision of an anti-reflection film.

While a preferred embodiment of the invention has been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

a vacuum envelope including an anode substrate and a transparent front cover;

wiring conductors provided on the inner surface of said anode substrate;

a cross layer formed with through-holes deposited on said wiring conductors;

anode conductors deposited on said cross layer in a predetermined pattern;

phosphors deposited on said anode conductors in a predetermined pattern so as to form a graphic display section and a segment display section;

a control electrode means arranged above each of said graphic display section and segment display section, said control electrode means comprising a first plurality of linear coplanar control electrodes being divided into several coplanar groups and extending in the direction perpendicular to the longitudinal direction of said anode substrate in parallel with each other at predetermined intervals; and filamentary cathodes arranged above said control electrode means so as to extend in the direction perpendicular to said control electrode means.

2. A fluorescent display device as defined in claim 1, wherein said graphic display section comprises dot-like anodes arranged in a matrix at predetermined intervals and said segment display section comprises a numeral display section and a letter display section.

3. A fluorescent display device as defined in claim 2, wherein said control electrodes are divided into at least two groups for each numeral and letter display section and said control electrodes in each group are connected in common.

4. A fluorescent display device as defined in claim 2, wherein said numeral display section comprises two numeral display section and a day display section.

* * * * *